US010805754B2

(12) United States Patent
Christoph et al.

(10) Patent No.: US 10,805,754 B2
(45) Date of Patent: Oct. 13, 2020

(54) AUDIO REPRODUCTION SYSTEMS AND METHODS

(71) Applicant: Harman Becker Automotive Systems GmbH, Karlsbad (DE)

(72) Inventors: Markus Christoph, Straubing (DE); Sunish George J. Alumkal, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/513,620

(22) PCT Filed: Sep. 22, 2015

(86) PCT No.: PCT/EP2015/071639
§ 371 (c)(1),
(2) Date: Mar. 23, 2017

(87) PCT Pub. No.: WO2016/046152
PCT Pub. Date: Mar. 31, 2016

(65) Prior Publication Data

US 2017/0295445 A1 Oct. 12, 2017

(30) Foreign Application Priority Data

Sep. 24, 2014 (EP) ..... 14186097

(51) Int. Cl.
*H04S 7/00* (2006.01)

(52) U.S. Cl.
CPC ..... *H04S 7/301* (2013.01); *H04S 7/306* (2013.01)

(58) Field of Classification Search
CPC ..... H04S 7/301; H04S 7/304; H04S 7/305; H04S 7/306; H04S 7/307; H04S 1/005;
(Continued)

(56) References Cited

U.S. PATENT DOCUMENTS

2003/0179891 A1* 9/2003 Rabinowitz ..... H04S 7/307 381/103
2006/0045294 A1 3/2006 Smyth
(Continued)

FOREIGN PATENT DOCUMENTS

EP 3001701 A1 3/2016
JP 01240099 A 9/1989
(Continued)

OTHER PUBLICATIONS

English Translation of Japanese Final Office Action for Application No. 2017-507406, dated Jun. 2, 2020, 7 pages.
(Continued)

*Primary Examiner* — Jason R Kurr
(74) *Attorney, Agent, or Firm* — Brooks Kushman P.C.

(57) ABSTRACT

The system and method includes positioning a mobile device with a built-in loudspeaker at a first location in a listening environment and at least one microphone at at least one second location in the listening environment; emitting test audio content from the loudspeaker of the mobile device at the first position in the listening environment; receiving the test audio content emitted by the loudspeaker using the at least one microphone at the at least one second location in the listening environment; and, based at least in part on the received test audio content, determining one or more adjustments to be applied to desired audio content before playback by at least one earphone; wherein the first location and the second location are distant from each other so that the at least one microphone is within the near-field of the loudspeaker.

17 Claims, 9 Drawing Sheets

(58) Field of Classification Search
CPC ..... H04R 1/10; H04R 1/1016; H04R 3/04; H04R 5/033
See application file for complete search history.

(56) References Cited

U.S. PATENT DOCUMENTS

2006/0050908 A1* 3/2006 Shteyn ..... H04S 3/004 381/309
2006/0274901 A1 12/2006 Terai et al.
2007/0270988 A1 11/2007 Goldstein et al.
2008/0298604 A1* 12/2008 Starobin ..... H03G 5/025 381/73.1
2010/0272270 A1 10/2010 Chaikin et al.
2011/0135101 A1 6/2011 Matsuura
2013/0028429 A1 1/2013 Amada et al.
2013/0216071 A1* 8/2013 Maher ..... H04R 3/04 381/303
2014/0334644 A1* 11/2014 Selig ..... H03G 5/165 381/108
2015/0223002 A1* 8/2015 Mehta ..... H04S 7/30 381/303
2015/0326815 A1 11/2015 Masuda et al.
2015/0350804 A1 12/2015 Crockett et al.
2016/0035337 A1* 2/2016 Aggarwal ..... H03G 3/20 381/94.2
2016/0174013 A1* 6/2016 Pallone ..... H04S 1/005 381/1
2017/0006403 A1* 1/2017 Fontana ..... G01H 7/00

FOREIGN PATENT DOCUMENTS

JP H05199596 A 8/1993
JP 2001134272 A 5/2001
JP 2004128854 A 4/2004
JP 2013031076 A 2/2013
WO 2013126603 A1 8/2013
WO 2014036085 A1 3/2014
WO 2014002640 A1 5/2016

OTHER PUBLICATIONS

English Translation of Indian Office Action for Application No. 201747009273, dated May 29, 2020, 6 pages.

* cited by examiner

AUDIO REPRODUCTION SYSTEMS AND METHODS

CROSS-REFERENCE TO RELATED APPLICATION

This application is the U.S. national phase of PCT Application No. PCT/EP2015/071639 filed on 22 Sep. 2015, which claims priority to European Patent Application No. 14186097.3 filed on Sep. 24, 2014 the disclosures of which are incorporated in their entirety by reference herein.

TECHNICAL FIELD

The disclosure relates to audio reproduction systems and methods, in particular to audio reproduction systems and methods with a higher degree of individualization.

BACKGROUND

A number of algorithms exist on the market for binaural playback of audio content over earphones. They are based on synthetic binaural room impulse responses (BRIR), which means they are based on generalized head-related transfer functions (HRTF) such as standard dummy heads or generalized functions from a large HRTF database. In addition, some algorithms allow users to select the most suitable BRIR from a given set of BRIRs. Such options can improve the listening quality; they include externalization and out-of-head localization, but individualization (for example, head shadowing, shoulder reflections or the pinna effect) is missing from the signal processing chain. Pinna information especially is as unique as a fingerprint. The addition of individualization by way of a personal BRIR can increase naturalness.

SUMMARY

The method described herein includes the following procedures: positioning a mobile device with a built-in loudspeaker at a first location in a listening environment and at least one microphone at at least one second location in the listening environment; emitting test audio content from the loudspeaker of the mobile device at the first position in the listening environment; receiving the test audio content emitted by the loudspeaker using the at least one microphone at the at least one second location in the listening environment; and, based at least in part on the received test audio content, determining one or more adjustments to be applied to desired audio content before playback by at least one earphone; wherein the first location and the second location are distant from each other so that the at least one microphone is within the near-field of the loudspeaker.

The system for measuring the binaural room impulse responses includes a mobile device with a built-in loudspeaker disposed at a first location in a listening environment and at least one microphone disposed at at least one second location in the listening environment. The mobile device is configured to emit test audio content via the loudspeaker at the first position in the listening environment and to receive from the earphones the test audio content emitted by the loudspeaker and received by the earphones at the at least one second location in the listening environment. The mobile device is further configured, based at least in part on the received audio content, to determine one or more adjustments to be applied to desired audio content by the mobile device before playback by the earphones, wherein the first location and the second location are distant from each other so that the at least one microphone is within the near-field of the loudspeaker.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
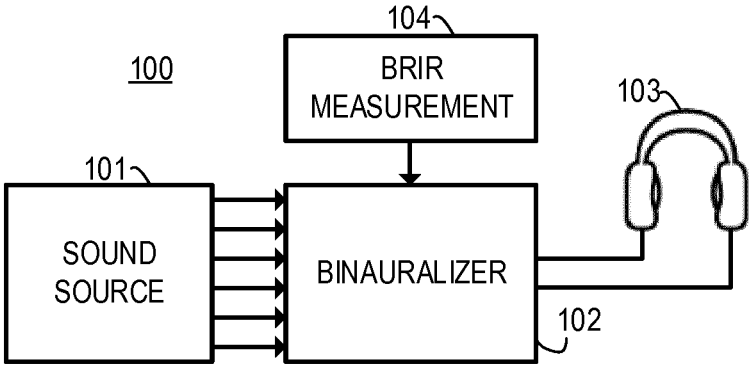
FIG. 1 is a schematic diagram of an exemplary audio system for binaural playback of two-channel stereo, 5.1-channel stereo or 7.1-channel stereo signals.

A Recorded "surround sound" is typically delivered through five, six, seven or more speakers. Real world sounds come to users (also herein referred to as "listeners", particularly when it comes down to their acoustic perception) from an infinity of locations. Listeners readily sense direction on all axes of three-dimensional space, although the human auditory system is a two-channel system. One route into the human auditory system is via headphones (also herein referred to as "earphones", particularly when it comes down to the acoustic behavior relative to each individual ear). The weakness of headphones is their inability to create a spacious and completely accurate sonic image in three dimensions. Some "virtual surround" processors have made incremental progress in this regard, as headphones are in principle able to provide a sonic experience as fully spacious, precisely localized and vivid as that created by multiple speakers in a real room.

Sounds that come from various directions are altered as they encounter the shape and dimensions of the head and upper torso and the shape of the outer ear (pinna). The human brain is highly sensitive to these modifications, which are not perceivable as tonal alterations; they are rather experienced by listeners quite accurately, as localized up, down, front, back or in between. This acoustic alteration can be expressed by the HRTF.

One type of recording has recognized that two audio channels can recreate a three-dimensional experience. Binaural recordings are made with a single pair of closely spaced microphones and are intended for headphone listening. Sometimes the microphones are embedded in a dummy head or head/torso to create an HRTF, in which case the sense of three-dimensionality is enhanced. The reproduced sound space can be convincing, though with no reference to the original environment, its accuracy cannot be attested. In any case, these are specialized recordings rarely seen in the commercial catalogue. Recordings intended to capture sounds front, rear and sometimes above are made with multiple microphones, are stored on multiple channels and are intended to be played back on multiple speakers arrayed around the listener.

Other systems (such as the Smyth Realiser) provide a completely different experience in which a multichannel recording (including stereo) sounds indistinguishably the same through headphones as it does through a loudspeaker array in a real room. In principle, the Smyth Realiser is similar to other systems in that it applies HRTFs to multichannel sound to drive the headphones. But along with other refinements, the Smyth Realiser employs three critical components not seen in other products: personalization, head tracking and the capture of the properties of every real listening space and sound system. The Smyth Realiser includes a pair of tiny microphones inserted into earplugs, which are placed in the listener's ears for measurement. The listener sits at the listening position within the array of loudspeakers, typically 5.1- or 7.1-channel, but any configuration, including height channels, can be accommodated. A brief set of test signals is played through the loudspeakers, then the listener puts on the headphones and a second brief set of measurements is taken. The whole procedure takes less than five minutes. In the measurement with the speakers, the Smyth Realiser not only captures the personal HRTF of the listener, but completely characterizes the room, the speakers and the electronics driving the speakers. In the measurement with the headphones, the system gathers data to correct for the interaction of the headphones and the ears and the response of the headphones themselves. The composite data is stored in memory and can be used to control equalizers connected in the audio signal paths.

As can be seen, the effort needed to take binaural measurement is cumbersome due to the need for dedicated measurement microphones, sound cards and other equipment. The methods and systems described herein allow for measuring BRIRs by way of smartphones to ease binaural measurement without the use of expensive hardware.

FIG. 1 is a schematic diagram of an exemplary audio system 100 for binaural playback of two-channel stereo, 5.1-channel stereo or 7.1-channel stereo signals provided by signal source 101, which could be a CD player, DVD player, vehicle head unit, MPEG surround sound (MPS) decoder or the like. Binauralizer 102 generates two-channel signals for earphones 103 from the two-channel stereo, 5.1-channel stereo or 7.1-channel stereo signals provided by signal source 101. BRIR measuring system 104 allows for measuring the actual BRIR and provides signals representing the BRIR to binauralizer 102 so that a multichannel recording (including stereo) sounds indistinguishably the same through earphones 103 as it would through a loudspeaker array in a real room. The exemplary audio system 100 shown in FIG. 1 may be used to deliver personalizer multichannel content for automotive applications and may be targeted for all types of headphones (i.e., not only for on-ear headphones, but also for in-ear headphones).

Figure 2:
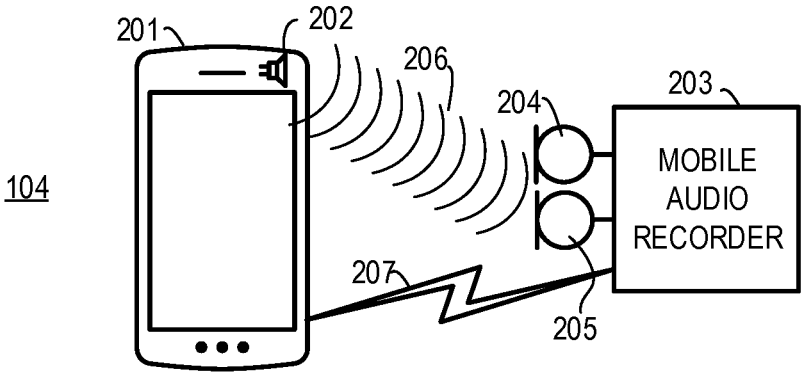
FIG. 2 is a schematic diagram of an exemplary system for measuring the BRIR using a smartphone and a mobile microphone recorder.

FIG. 2 is a schematic diagram of an exemplary BRIR measuring system 104 that uses smartphone 201 (or a mobile phone, phablet, tablet, laptop, etc.), which includes loudspeaker 202 and mobile audio recorder 203 connected to two microphones 204 and 205. Loudspeaker 202 of smartphone 201 radiates sound captured by microphones 204 and 205, thereby establishing acoustic transfer paths 206 between loudspeaker 202 and microphones 204 and 205. Digital data, including digital audio signals and/or instructions, are interchanged between smartphone 201 and recorder 203 by way of bidirectional wireless connection 207, which could be a Bluetooth (BT) connection.

Figure 3:
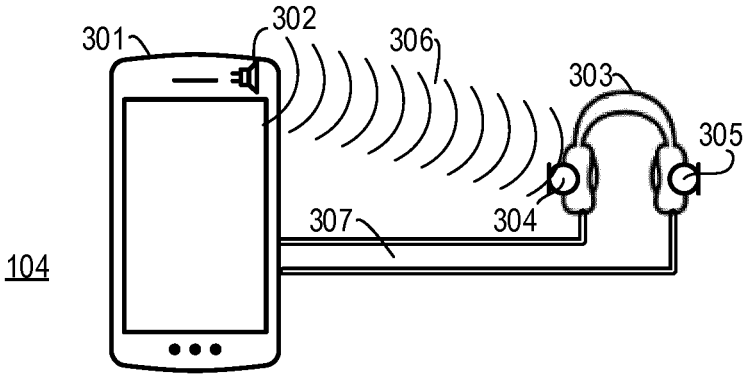
FIG. 3 is a schematic diagram of another exemplary system for measuring the BRIR using a smartphone and headphone microphones.

FIG. 3 is a schematic diagram of another exemplary BRIR measuring system 104 that uses a smartphone 301, which includes loudspeaker 302 and headphones 303 equipped with microphones 304 and 305. Loudspeaker 302 of smartphone 301 radiates sound captured by microphones 304 and 305, thereby establishing acoustic transfer paths 306 between loudspeaker 302 and microphones 304 and 305. Digital or analog audio signals are transferred from microphones 304 and 305 to smartphone 301 by way of wired line connection 307, or alternatively by way of a wireless connection such as a BT connection (not shown in FIG. 3). The same or a separate wired line connection or wireless connection (not shown in FIG. 3) may be used to transfer digital or analog audio signals from smartphone 301 to headphones 303 for reproduction of these audio signals.

Figure 4:
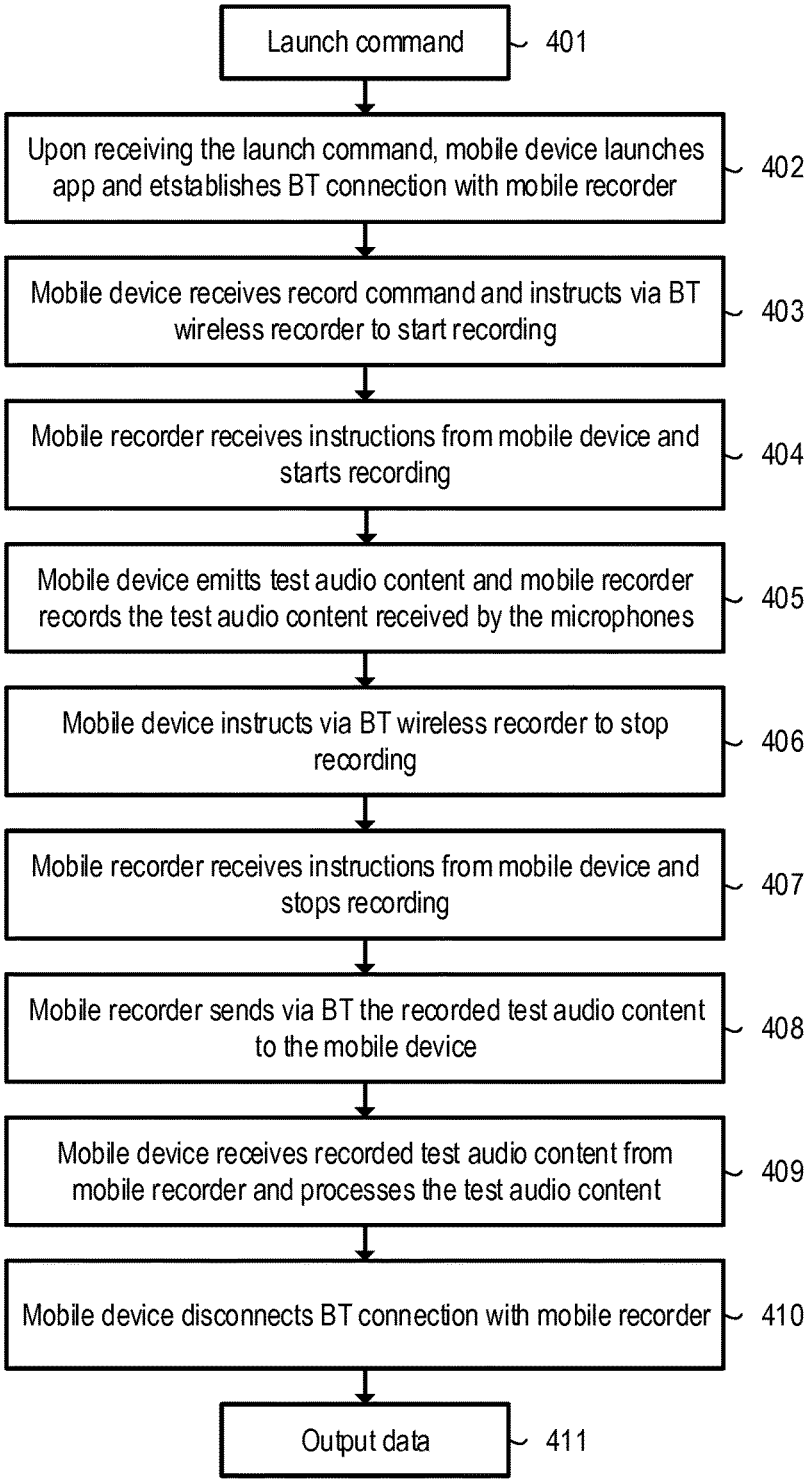
FIG. 4 is a flowchart of an exemplary method for measuring the BRIR using a smartphone.

Referring to FIG. 4, a launch command from a user may be received by a mobile device such as smartphone 201 in the system shown in FIG. 2 (procedure 401). Upon receiving the launch command, smartphone 201 launches a dedicated software application (app) and establishes a BT connection with mobile audio recorder 203 (procedure 402). Smartphone 201 receives a record command from the user and instructs mobile audio recorder 203 via BT connection 207 to start recording (procedure 403). Mobile audio recorder 203 receives instructions from smartphone 201 and starts recording (procedure 404). Smartphone 201 emits test audio content via built-in loudspeaker 202, and mobile audio recorder 203 records the test audio content received by microphones 204 and 205 (procedure 405). Smartphone 201 instructs mobile audio recorder 203 via BT to stop recording (procedure 406). Mobile audio recorder 203 receives instructions from smartphone 201 and stops recording (procedure 407). Mobile audio recorder 203 subsequently sends the recorded test audio content to smartphone 201 (procedure 408) via BT; smartphone 201 receives the recorded test audio content from mobile audio recorder 203 and processes the received test audio content (procedure 409). Smartphone 201 then disconnects the BT connection with the mobile recorder (procedure 410) and outputs data that represents the BRIR (procedure 411). A process similar to that shown in FIG. 4 may be applied in the system shown in FIG. 3, but wherein audio recording is performed within the mobile device (smartphone 301).

In a study, four stimuli (test audio content) were considered in connection with the exemplary system shown in FIG. 2: balloon burst 501, two different types of handclaps 502 and 503 and sine sweep 504. These stimuli were recorded about one meter from a specific measurement microphone in an anechoic chamber. The magnitudes of the impulse responses of these measurements are given in FIG. 5. It can be seen from the graphs that the two hand claps 502 and 503 are not ideal in their current forms, as they differ significantly from sine sweep 504's measurement. For comparison, impulse stimulus 505 is also shown. Frequency responses should ideally be measured in an anechoic chamber. However, non-experts normally do not have access to an anechoic chamber. An alternative is to use near-field measurement, which is technically viable by using the same microphone that is used for binaural measurement. Accordingly, a single handclap recording may not necessarily give the desired characteristics of the room. Therefore, more practical effort is needed from the end user to take the measurements. However, it is desired to make the measurement procedure as simple as possible and reliable for the ordinary user.

Acoustic sources such as loudspeakers have both near-field and far-field regions. Within the near-field, wavefronts produced by the loudspeaker (or speaker for short) are not parallel, and the intensity of the wave oscillates with the range. For that reason, echo levels from targets within the near-field region can vary greatly with small changes in location. Once in the far-field, wavefronts are nearly parallel, and intensity varies with the range, squared under the inverse-squared rule. Within the far-field, the beam is properly formed and echo levels are predictable from standard equations.

Figure 5:
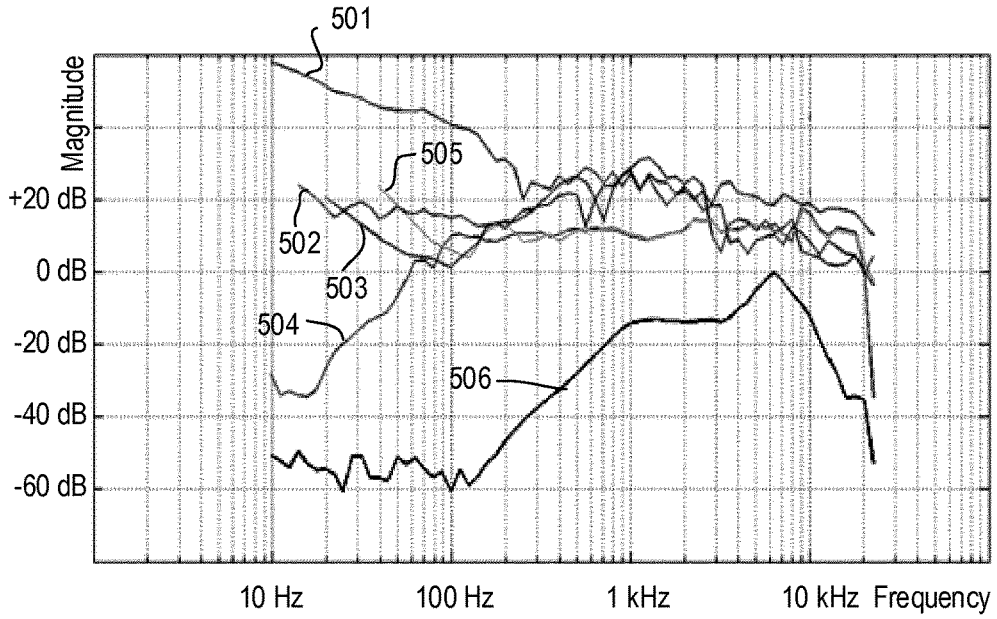
FIG. 5 is a diagram illustrating the frequency responses of different stimuli.
Figure 6:
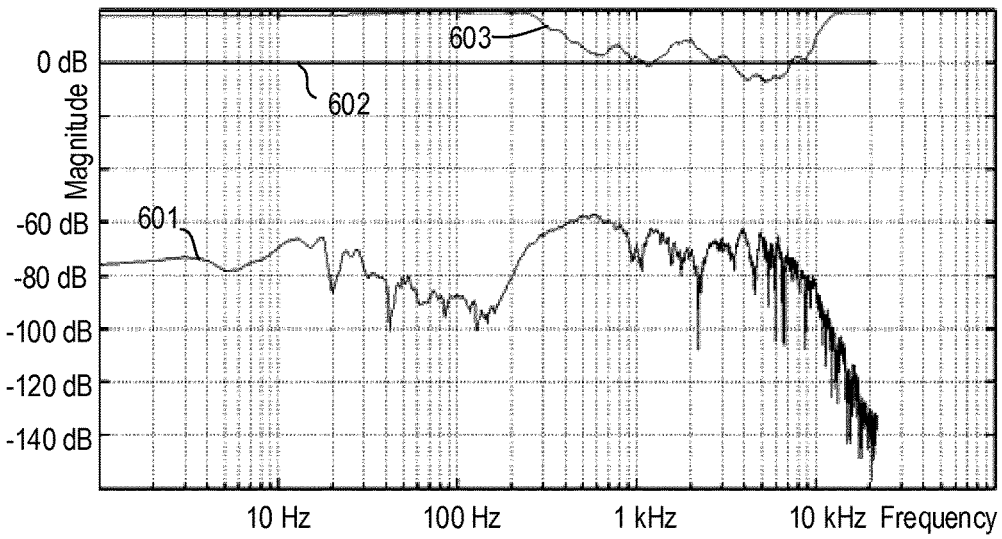
FIG. 6 is a diagram illustrating the frequency responses of a rear smartphone loudspeaker (obtained from a near-field measurement), an exemplary target frequency response and an inverse filter.

It can be seen from FIG. 5 that smartphone speakers exhibit poor response 506 in low-frequency regions. A peak can also be seen at around 6 kHz. Despite these deficiencies, smartphone speakers may be still considered for the reasons mentioned below:

a) Although smartphone speakers have a limited frequency response, they can still render signals above approximately 600 Hz (see also FIG. 6).

b) If the smartphone speaker itself is used to render measurement stimuli, the end user does not need to carry additional objects such as balloons for measurement.

c) The swept sine stimulus is proven and widely used by many manufacturers and researchers; it can easily be implemented in smartphones.

d) The user can move the smartphone (speaker) to any location around his head. This gives the flexibility of measuring the BRIR at any combination of azimuth and elevation.

Magnitude response 601 of an exemplary smartphone speaker generated from near-field measurement is shown in FIG. 6, from which it can be seen that the spectrum has uniform characteristics from about 700 Hz onwards. Also shown are a "flat" target function 602 and an exemplary inverse filter function 603, applicable to adapt magnitude response 601 to target function 602.

Two exemplary algorithms for BRIR calculation are described below. Using the BRIR resulting from a headphone real room (HRR) process, a user's favorite content can be listened to via headphones, including the information of the measured room. Using the BRIR resulting from a headphone virtual room (HVR) process, a user's favorite content can be listened to via headphones, including only binaural information. However, the user can optionally include a virtual room in the signal chain.

HRR systems and methods intend to render binaural content with included listeners' room information via headphones (earphones). A flow chart of an exemplary application of a BRIR measurement in an HRR system that includes smartphone 701 is given in FIG. 7 and is described in more detail further below. Brief descriptions of the building blocks and procedures are also given below.

Measurement of the BRIR is taken by using smartphone speaker 702 and placing binaural microphones (not shown) at the entrances of the user's ear canals. A sweep sine signal for spectral analysis is played back over smartphone speaker 702 at the desired azimuth and elevation angles. A specially designed pair of binaural microphones may be used that completely block the listener's ear canals. The microphones may be a separate set of binaural microphones, and the measurement hardware may be separated from smartphone 701, similar to the system shown in FIG. 2. Alternatively, the earphone transducers themselves may be used as transducers for capturing sound. The measurement, preprocessing and final computation of the BRIR may be done by smartphone 701 using a mobile app that performs, for example, the process described above in connection with FIG. 4. Instead of a frequency-by-frequency spectrum analysis (e.g., a sweeping narrowband stimulus in connection with a corresponding narrowband analysis, as described above), a broadband stimulus or impulse may be used in connection with a broadband spectrum analysis such as a fast Fourier transformation (FFT) or filter bank.

Figure 8:
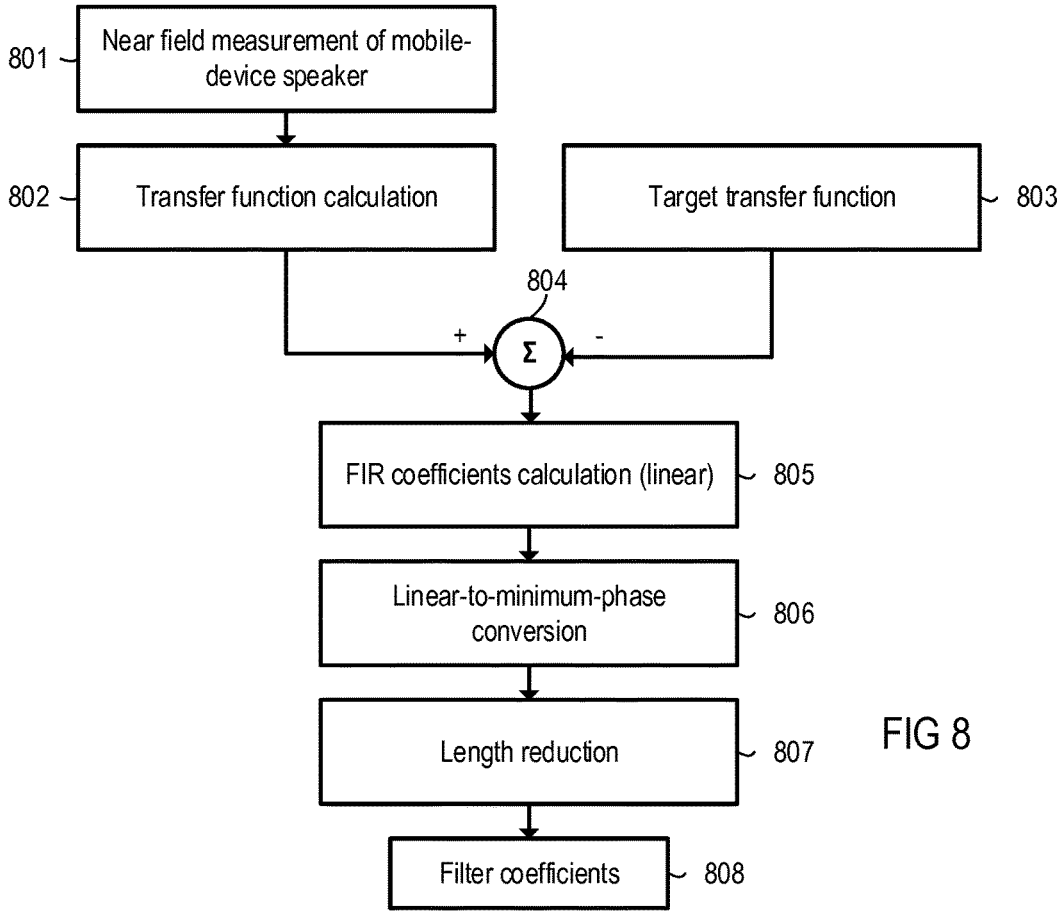
FIG. 8 is a flowchart of an exemplary method for calculating an inverse filter to correct the smartphone speaker deficiency.
Figure 9:
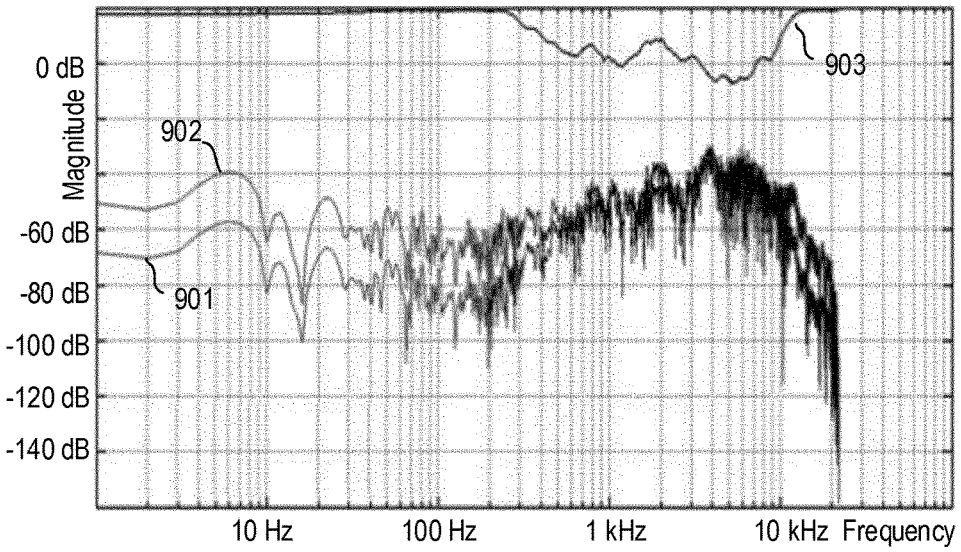
FIG. 9 is a diagram illustrating the comparison of frequency responses before and after the correction of the smartphone speaker deficiency.

Concerning correction for the smartphone speaker deficiency, a full bandwidth loudspeaker is ideally required to cover all frequency ranges while measuring the BRIR. Since a limited band speaker is used for measurement, namely smartphone speaker 701, it is necessary to cover the missing frequency range. For this, a near-field measurement is taken using one of the binaural microphones. From this, an inverse filter with an exemplary magnitude frequency characteristic (also known as "frequency characteristic" or "frequency response"), as shown in FIG. 5, is calculated and applied to the left and right ear BRIR measurements. In the given example, the target magnitude frequency response curve is set to flat, but may be any other desired curve. Information such as phase and level differences are not compensated in this method, but may be if desired. A flow chart of this process is shown in FIG. 8. The process includes near-field measurement of the magnitude frequency response of smartphone speaker 702 (procedure 801). The corresponding transfer function (also known as "transfer characteristic") of the acoustic path between smartphone speaker 702 and the measuring microphone is calculated (procedure 802) and added to inverse target magnitude frequency function 803 (procedure 804). The (linear) finite impulse response (FIR) filter coefficients are then calculated (procedure 805) and processed to perform a linear-to-minimum-phase conversion (procedure 806). After a subsequent length reduction of the filter coefficients performed by procedure 806 (procedure 807), the length-reduced filter coefficients are output (procedure 808). A comparison of results after applying the correction is given in FIG. 9, in which graph 901 depicts the magnitude frequency characteristic measured before equalization, graph 902 depicts the magnitude frequency characteristic measured after equalization and graph 903 depicts the magnitude frequency characteristic used for equalisation.

Figure 10:
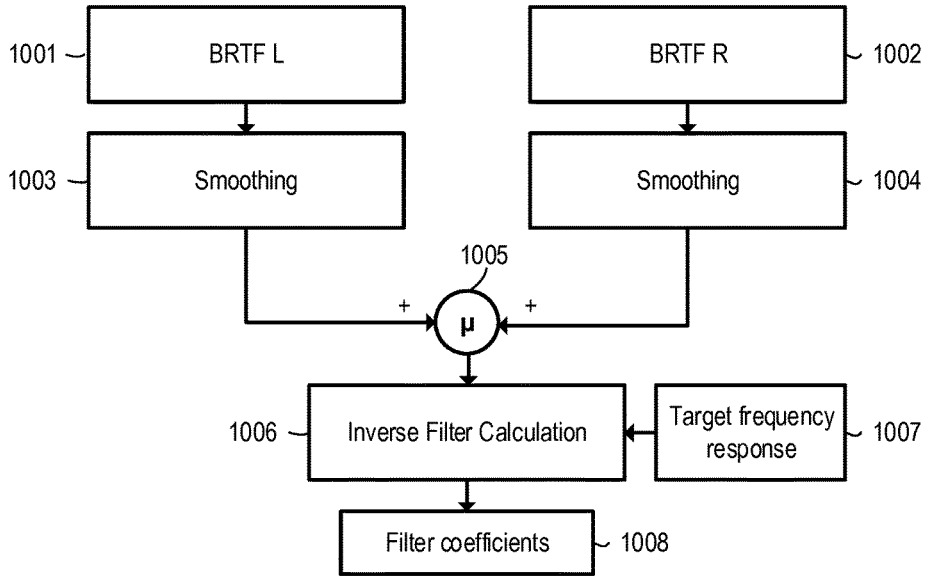
FIG. 10 is a flowchart of an exemplary spectral balancer algorithm.

Regarding the (optional) spectral balancer, an additional equalization can be applied if the user wishes to embed a certain tonality in the sound. For this, an average of the left ear and right ear BRIRs is taken. A flow chart of the process is given in FIG. 10. The process includes providing body-related transfer function BRTF L for the left ear (procedure 1001), determining binaural transfer function BRTF R for the right ear (procedure 1002), smoothing (e.g., lowpass filtering) (procedures 1003 and 1004) and summing up the smoothed binaural transfer functions BRTF L and BRTF R (procedure 1005). The sum provided by procedure 1005 and target magnitude frequency response 1007 are then used to calculate the filter coefficients of a corresponding inverse filter (procedure 1006). The filter coefficients are output in procedure 1008.

Figure 11:
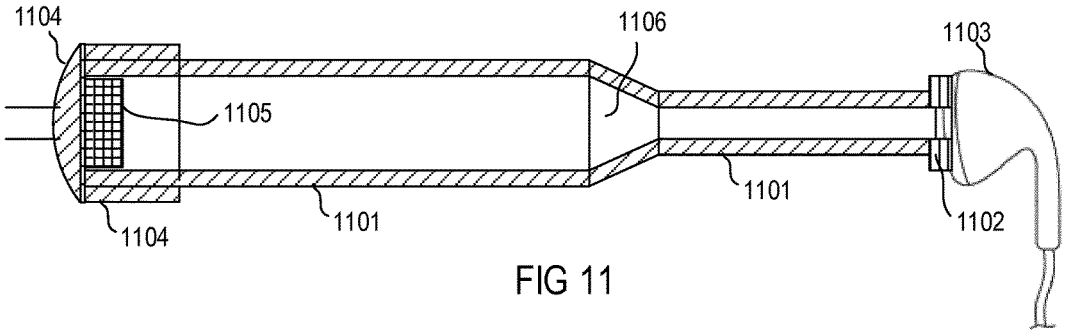
FIG. 11 is a schematic diagram of exemplary equipment for the measurement of earphone characteristics.

Regarding the headphone equalizer, since there is a huge variation of frequency characteristics for earphones, sometimes even within the same manufacturing company, applying an equalizer to compensate for influence from earphones is required. To do this, the frequency response of the particular earphone is required. This measurement of the earphone characteristics can be taken using simple equipment, as shown in FIG. 11. The equipment for measuring the earphone characteristics includes a tubular body (herein referred to as "tube 1101") whose one end includes adaptor 1102 to couple (in-ear) earphone 1103 to tube 1101 and whose other end is equipped with a closing cap 1104 and a microphone 1105 disposed in tube 1101 close to cap 1104. In practice, one of the binaural microphones could be used instead of microphone 1105 shown in FIG. 11. Tube 1101 may have diameter constriction 1006 somewhere between the two ends. Volume, length and diameter of the tube 1101 should be similar to that of an average human ear canal. The equipment shown can mimic the pressure chamber effect; the measured response can therefore be close to reality.

Figure 12:
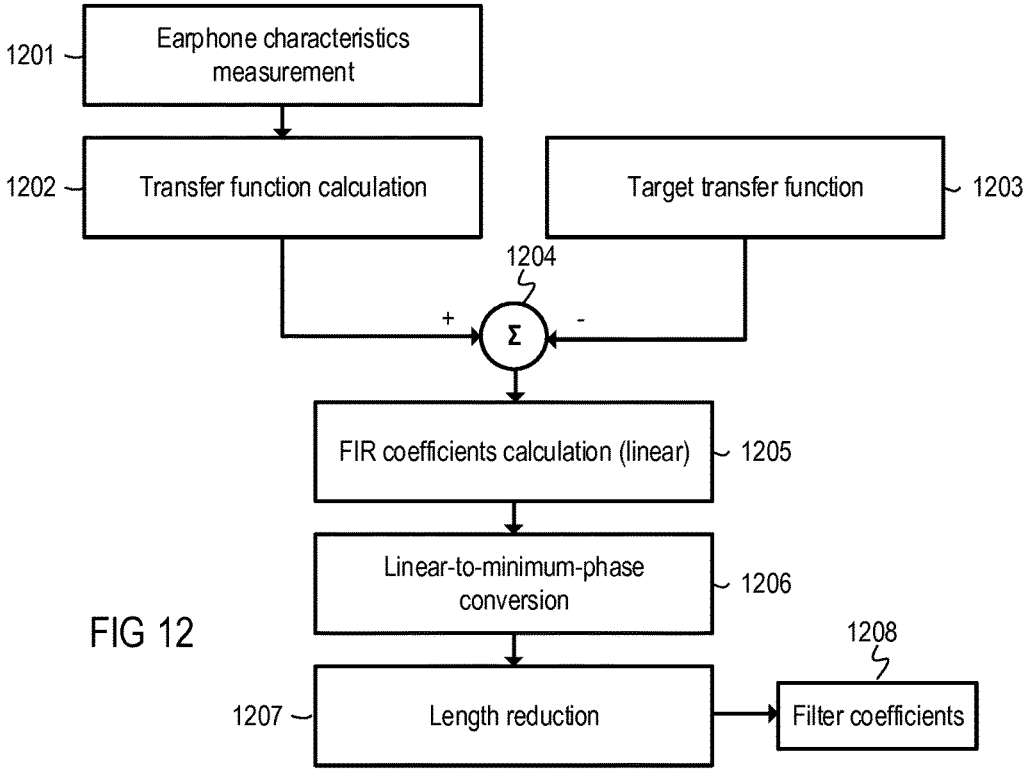
FIG. 12 is a flowchart of an exemplary earphone equalizer algorithm.

A schematic of a corresponding measuring process is given in FIG. 12. The process includes measuring the earphone characteristics (procedure 1201) and calculating the corresponding transfer function therefrom (procedure 1202). Furthermore, a target transfer function 1203 is subtracted from the transfer function provided by procedure 1202 in procedure 1204. From this sum, the FIR coefficients are (linearly) calculated (procedure 1205) to subsequently perform a linear-to-minimum-phase conversion (procedure 1206) and a length reduction (procedure 1207). Finally, filter coefficients 1208 are output to other applications and/or systems.

Referring again to FIG. 7, the process shown includes near-field measurement of the magnitude frequency response of the mobile device's speaker, which in the present case is smartphone speaker 702 (procedure 703). From the signal resulting from procedure 703, the magnitude frequency response of smartphone speaker 702 is calculated (procedure 704). An inverse filter magnitude frequency response is then calculated from target magnitude frequency response 706 and the calculated magnitude frequency response of smartphone speaker 702 (procedure 705). After starting and performing a BRIR measurement using smartphone speaker 702 (procedure 707), the measured BRIR and the calculated inverse filter magnitude frequency response are convolved (procedure 708). The signal resulting from procedure 708 is processed by a room equalizer (procedure 709) based on a corresponding target frequency response 710. The signal resulting from procedure 709 is processed by an earphone equalizer (procedure 711) based on a corresponding target frequency response 712. The signal resulting from procedure 711 is convolved (procedure 713) with N mono audio files 714 (e.g., N=2 stereo signals, N=6 5.1-channel signals or N=8 7.1-channel signals), and the result of this convolution is output to earphones (procedure 715).

A headphone virtual room (HVR) system intends to render binaural content without included listeners' room information via earphones. Listeners can optionally include a virtual room in the chain. A schematic of the process is given in FIG. 13. Brief descriptions of additional building blocks are given below. This process also needs the building blocks mentioned above in connection with FIGS. 7-12. Only additional building blocks such as deverberators and artificial reverberators are described in the following.

Figure 14:
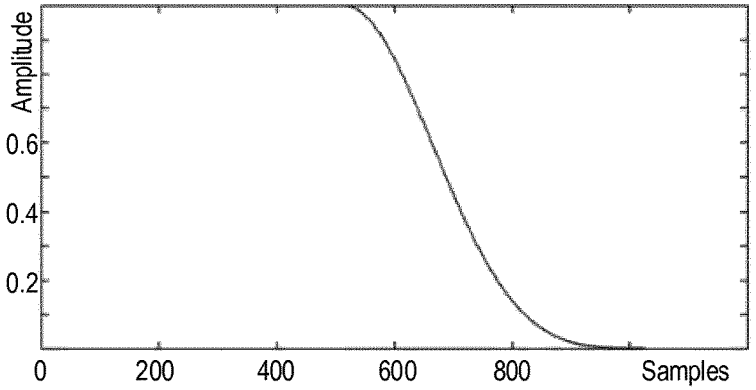
FIG. 14 is a diagram of a windowing function used in a dereveberator.
Figure 15:
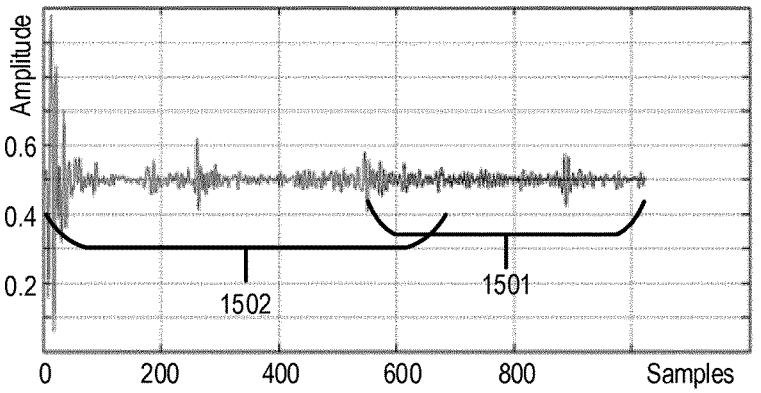
FIG. 15 is a diagram of a BRIR before and after the application of the windowing function shown in FIG. 14.

Dereverberator/Smoothing: If the measured room impulse response contains unnecessary peaks and notches, unpleasant timbral artifacts may degrade the sound quality. To get rid of the room information or to remove the early and late reflections, (temporal and/or spectral) windowing techniques can be incorporated. In the application, a combination of rectangular and Blackman-Harris windows is used, as shown in FIG. 14. Exemplary BRIRs before (1501) and after (1502) smoothing are given in FIG. 15.

Artificial reverberator: In the previous block, all room-related information has been removed. That is, only directional information (e.g., interaural time difference [ITD] and interaural level difference [ILD]) is contained in the BRIR after the application of a windowing function (window). Sources therefore appear to be very close to the ears. An artificial reverberator can thus optionally be used if there is a need to incorporate distance information. Any state-of-the-art reverberator can be used for this purpose.

Figure 7:
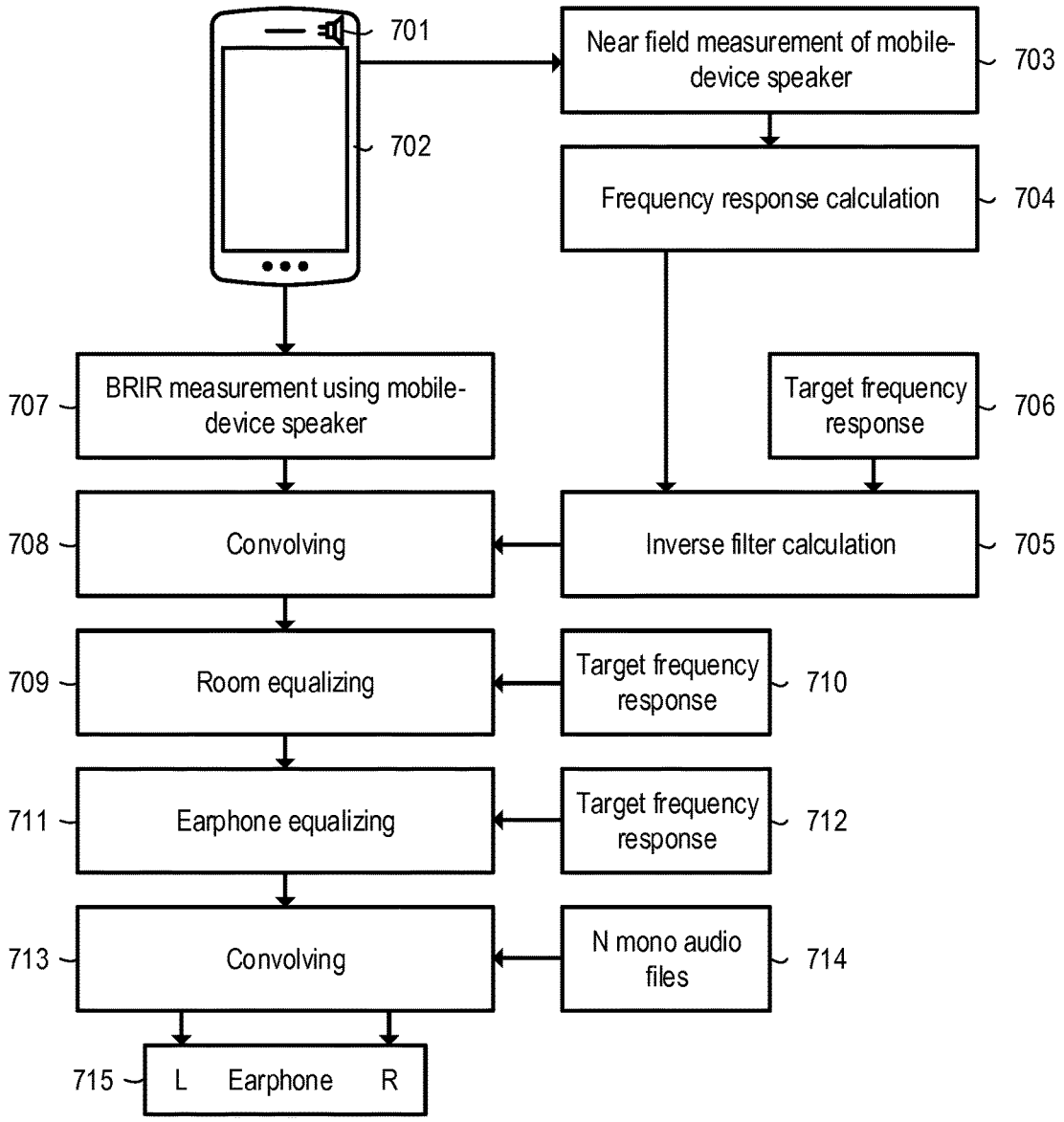
FIG. 7 is a flowchart of an exemplary application of a BRIR measurement in a headphone real room system.
Figure 13:
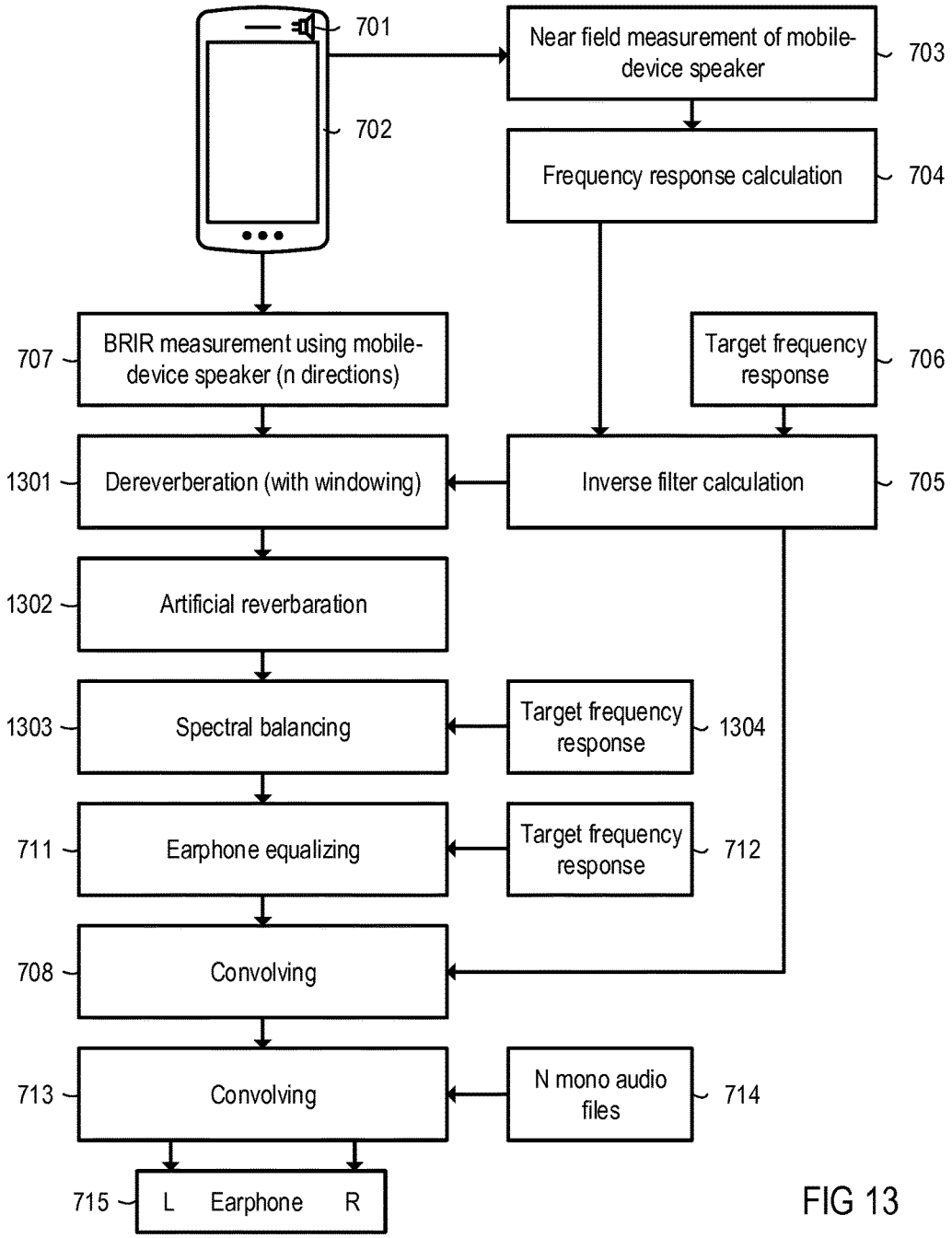
FIG. 13 is a flowchart of an exemplary application of a BRIR measurement in a headphone virtual room system.

As can be seen from FIG. 13, dereverberation and artificial reverberation procedures 1301 and 1302 are inserted between BRIR measurement process 707 and earphone equalizing procedure 711 in the process shown in FIG. 7. Furthermore, room equalizing procedure 709 and the corresponding target magnitude frequency response 710 may be substituted by spectral balancing procedure 1303 and a corresponding target magnitude frequency response 1304. Dereverberation procedure 1301, which may include windowing with a given window, and convolution procedure 708 receive the output of inverse filter calculation procedure 705, wherein convolution procedure 708 may now take place between earphone equalizing procedure 711 and convolution procedure 713.

Figure 16:
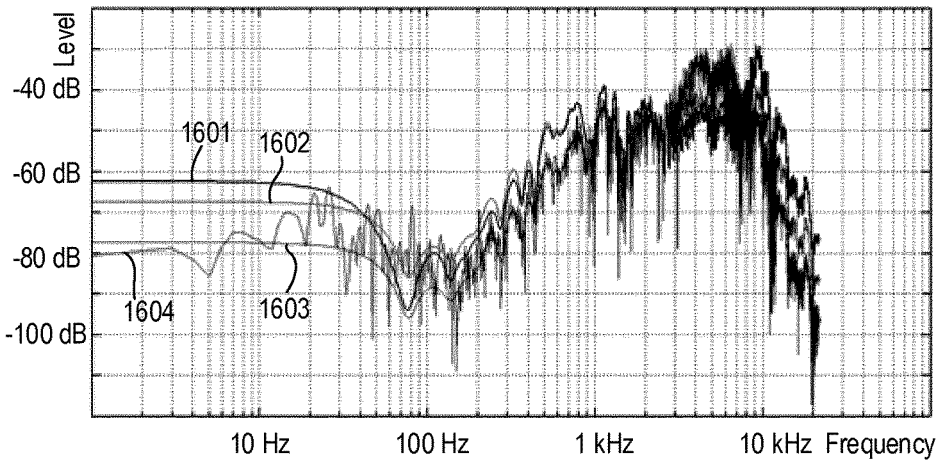
FIG. 16 is a diagram illustrating a comparison of the magnitude responses of various exemplary measured BRIRs.
Figure 17:
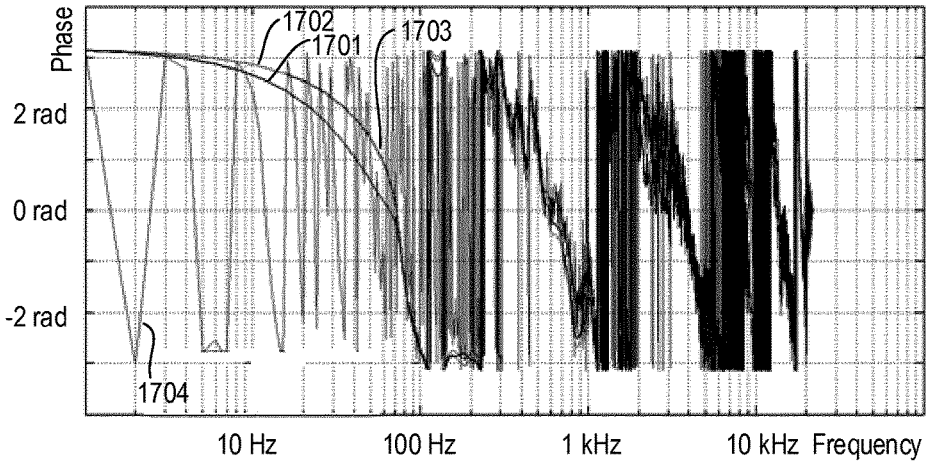
FIG. 17 is a diagram illustrating a comparison of the phase responses of the exemplary measured BRIRs that form basis for the diagram shown in FIG. 16.

Throughout this study, the focus was not to destroy the phase information of the BRIR. The magnitude frequency response in FIG. 16 and the phase frequency response in FIG. 17 of an exemplary BRIR are given. The magnitude frequency response shows that the BRIR's sharp peaks and notches are removed after applying the dereverberator algorithm. The phase response shows that even after dereverberation, the phase information is preserved to a great extent. Informal listening indicated that localizations of the convolved speeches were also not destroyed. In FIG. 16, graph 1601 depicts the magnitude frequency response after earphone equalization, graph 1602 depicts the magnitude frequency response after room equalization, graph 1603 depicts the magnitude frequency response after dereverberation and graph 1604 depicts the magnitude frequency response after smartphone deficiency correction. In FIG. 17, graph 1701 depicts the phase frequency response after earphone equalization, graph 1702 depicts the phase frequency response after room equalization, graph 1703 depicts the phase frequency response after dereverberation and graph 1704 depicts the phase frequency response after smartphone deficiency correction.

Figure 18:
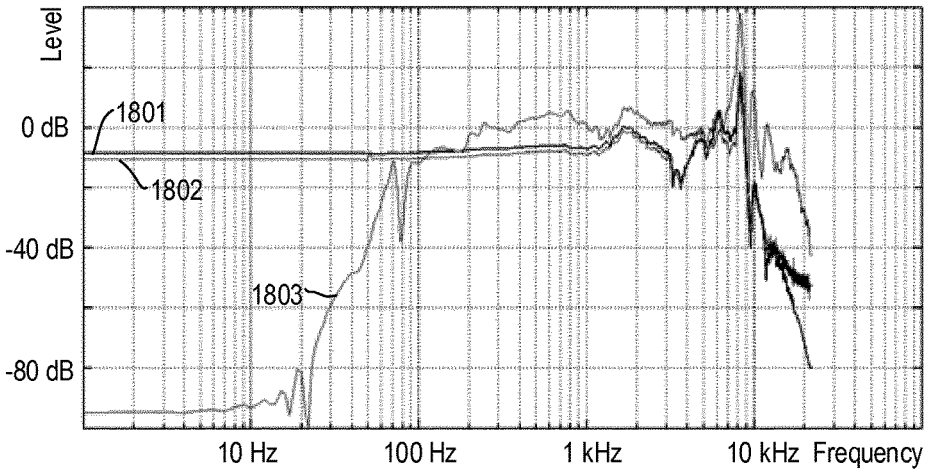
FIG. 18 is a diagram illustrating the magnitude responses of the earphone transducers used as microphones.

FIG. 18 shows the magnitude frequency responses of exemplary earphone transducers as microphones. Since the systems described herein may be targeted for consumer users, earphone transducers and housing may particularly be used as microphones. In a pilot experiment, measurements were taken using commercially available in-ear earphones as microphones. A swept sine signal going from 2 Hz to 20 kHz was played back through a speaker in an anechoic room. Earphone capsules were about one meter away from the speaker. For comparison, a reference measurement was also taken using a reference measurement system. The magnitude frequency responses of the measurements are given in FIG. 18, in which graph 1801 depicts the magnitude frequency responses of the left channel (1801), the right channel (1802) and the reference measurement (1803). It can be seen from the plots that the shapes of the curves corresponding to earphones are comparable to that of the reference measurement from about 1,000 Hz to 9,000 Hz.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A method comprising:

positioning a mobile device with a built-in loudspeaker in a listening environment and positioning at least one microphone in the listening environment distant from the loudspeaker;

measuring a magnitude frequency response of the loudspeaker using the at least one microphone;

measuring binaural room impulse responses using the loudspeaker; and based at least in part on the magnitude frequency response of the loudspeaker, applying one or more adjustments to the measured binaural room impulse responses;

wherein measuring the magnitude frequency response of the loudspeaker comprises:

emitting test audio content via the loudspeaker, wherein the test audio content corresponds to a sweep sine signal, a sweeping narrowband stimulus, a broadband stimulus or an impulse; and receiving the test audio content emitted by the loudspeaker via the at least one microphone to determine the magnitude frequency response of the loudspeaker by measuring a transfer function of an acoustic path between the loudspeaker and the at least one microphone;

the at least one microphone being within a near-field of the loudspeaker, and being one of a pair of earphones that are placed at the entrances of a user's ear canals and that completely block the ear canals.

2. The method of claim 1, wherein determining the one or more adjustments to be applied to the binaural room impulse responses comprises performing spectral analysis on a received playback of the test audio content to provide a frequency response of the received playback of the test audio content.

3. The method of claim 2, further comprising:

comparing the frequency response of the received playback of the test audio content to a target frequency response; and based at least in part on a comparison of the frequency response of the received playback of the test audio content with the target frequency response, determining the one or more adjustments to be applied to the binaural room impulse responses.

4. The method of claim 1, wherein the at least one microphone is provided by at least one in-ear earphone.

5. The method of claim 1, wherein the at least one microphone is used to receive the test audio content for measuring the binaural room impulse responses.

6. The method of claim 1, wherein:

the at least one earphone has emitter frequency characteristics when the at least one earphone is used as a speaker; and the emitter frequency characteristics of the at least one earphone are equalized based on a target emitter frequency characteristic when playing desired audio content.

7. The method of claim 1, further comprising a first further microphone and a second further microphone for measuring binaural room impulse responses, the first further microphone being positioned at a first location proximate to one ear of the user within the listening environment and a second further microphone being positioned at a first location proximate to the other ear of the user within the listening environment.

8. The method of claim 1, wherein a frequency characteristic of the at least one microphone is measured by using or mimicking a pressure chamber effect.

9. The method of claim 1, further comprising applying the measured binaural room impulse responses to desired audio content, before the desired audio content is played by the at least one earphone.

10. A system comprising:

a mobile device with a built-in loudspeaker disposed in a listening environment; and at least one microphone disposed at least one second location in the listening environment distant from the loudspeaker, wherein the mobile device is configured to measure a magnitude frequency response of the loudspeaker using the at least one microphone, to measure binaural room impulse responses using the loudspeaker, and, based at least in part on the magnitude frequency response of the loudspeaker, to apply one or more adjustments to the measured binaural room impulse responses, wherein measuring the magnitude frequency response of the loudspeaker comprises:

emitting test audio content via the loudspeaker, wherein the test audio content corresponds to a sweep sine signal, a sweeping narrowband stimulus, a broadband stimulus or impulse;

receiving the test audio content emitted by the loudspeaker with the at least one microphone to determine the magnitude frequency response of the loudspeaker by measuring a transfer function of an acoustic path between the loudspeaker and the at least one microphone;

the at least one microphone being within a near-field of the loudspeaker, and being one of a pair of earphones that are placed at the entrances of a user's ear canals and that completely block the ear canals.

11. The system of claim 10, wherein the microphone is an in-ear microphone.

12. The system of claim 10 further comprising an audio recorder connected between at least one further microphone and the mobile device, the audio recorder being controlled by the mobile device and being configured to record the test audio content received by the at least one further microphone and to transmit the recorded test audio content to the mobile device upon request for measuring the binaural room impulse responses.

13. A method comprising:

positioning in a listening environment, a mobile device with a loudspeaker and, distant from the loudspeaker, at least one microphone;

measuring a magnitude frequency response of the loudspeaker using the at least one microphone;

measuring binaural room impulse responses using the loudspeaker; and based at least in part on the magnitude frequency response of the loudspeaker, applying one or more adjustments to the measure binaural room impulse responses;

wherein measuring the magnitude frequency response of the loudspeaker comprises:

transmitting test audio content from the loudspeaker of the mobile device, wherein the test audio content corresponds to a sweep sine signal, a sweeping narrowband stimulus, a broadband stimulus or impulse;

receiving, via the at least one microphone, the test audio content transmitted by the loudspeaker to determine the magnitude frequency response of the loudspeaker by measuring a transfer function of an acoustic path between the loudspeaker and the at least one microphone; the at least one microphone being within a near-field of the loudspeaker, and being one of a pair of earphones that are placed at the entrances of a user's ear canals and that completely block the ear canals.

14. The method of claim 13, wherein determining the one or more adjustments to be applied to the measured binaural room impulse responses comprises performing spectral analysis on a received playback of the test audio content to provide a frequency response of the received playback of the test audio content.

15. The method of claim 14, further comprising:

comparing the frequency response of the received playback of the test audio content to a target frequency response; and based at least in part on a comparison of the frequency response of the received playback of the test audio content with the target frequency response, determining the one or more adjustments to be applied to the measured binaural room impulse responses.

16. The method of claim 13, wherein the at least one microphone is provided by at least one in-ear earphone.

17. The method of claim 13, wherein the at least one microphone is to receive the test audio content for measuring the binaural room impulse responses.

* * * * *